US007237702B2

(12) United States Patent
Landis et al.

(10) Patent No.: US 7,237,702 B2
(45) Date of Patent: Jul. 3, 2007

(54) FOLDING GARMENT HANGER

(76) Inventors: Gary Landis, 5148 Arrowhead La., Plano, TX (US) 75093; Cheryl Landis, 5148 Arrowhead La., Plano, TX (US) 75093; Ryan Landis, 5148 Arrowhead La., Plano, TX (US) 75093

( * ) Notice: Subject to any disclaimer, the term of this patent is extended or adjusted under 35 U.S.C. 154(b) by 393 days.

(21) Appl. No.: 10/830,349

(22) Filed: Apr. 22, 2004

(65) Prior Publication Data

US 2004/0211797 A1 Oct. 28, 2004

Related U.S. Application Data

(60) Provisional application No. 60/464,567, filed on Apr. 22, 2003.

(51) Int. Cl.
*A41D 27/22* (2006.01)

(52) U.S. Cl. ..... 223/89; 223/94

(58) Field of Classification Search ..... 223/85–98
See application file for complete search history.

(56) References Cited

U.S. PATENT DOCUMENTS 2,569,726 A * 10/1951 McPherson ..... 223/94
3,790,046 A * 2/1974 Rooney ..... 223/92
4,524,890 A * 6/1985 Fulton ..... 223/94
4,730,757 A * 3/1988 Keller ..... 223/94
4,813,581 A * 3/1989 LaMont ..... 223/94
4,988,021 A * 1/1991 Adams et al. ..... 223/94
5,383,584 A * 1/1995 Adams ..... 223/94
5,397,037 A * 3/1995 Ozawa ..... 223/94
5,480,076 A * 1/1996 Siegel et al. ..... 223/94
5,590,823 A * 1/1997 Lunde ..... 223/94
5,690,257 A 11/1997 Ward
5,810,216 A * 9/1998 Leopold ..... 223/85
5,813,578 A * 9/1998 Hsieh ..... 223/94
6,328,187 B2 * 12/2001 Sugita ..... 223/94
6,427,882 B1 * 8/2002 Harvey ..... 223/85
6,540,121 B1 * 4/2003 Harvey ..... 223/85

* cited by examiner

*Primary Examiner*—Shaun R. Hurley
(74) *Attorney, Agent, or Firm*—Jackson Walker LLP; Robert C. Klinger

(57) ABSTRACT

A garment hanger that folds around a point or series of points near the hook of the hanger, and is adapted to automatically extend to its original unfolded position upon release is disclosed. More specifically, an improved hanger, also referred to as a suspension device, with a hook, having a first member and a second member, with a pivot near the hook, adapted to allow movement of the first member and the second member between a first position and a second position is disclosed.

14 Claims, 10 Drawing Sheets

FOLDING GARMENT HANGER

PRIORITY TO PROVISIONAL APPLICATION

This application is related to U.S. Provisional Patent Application No. 60/464,567, filed on Apr. 22, 2003, entitled "Folding Garment Hanger", the entire contents of which are incorporated herein by this reference. The Applicant hereby claim the benefits of this earlier pending provisional application under 35 U.S.C. Section 119(e).

BACKGROUND OF THE INVENTION

Garments are frequently removed from their hangers by pulling from beneath. This action is especially common among children, who lack the height to reach the hanger from above and remove the hanger from the hanging rod. This action is not restricted to children, however. When a garment is removed from the hanger in such a manner, there are two several adverse effects, each of which is remedied by the present invention.

One adverse effect is that the neck of a shirt can be torn or stretched as it is forcibly pulled off of the hanger. Further, the hanger can be bent or broken under the stress of having the garment forcibly pulled over the wire or plastic "shoulders" of the hanger in one of the following ways: the lower, flat portion of a wire hanger may buckle in the middle, requiring the user to reshape the hanger; the lower, flat portion of a plastic hanger may break; the shoulder of a wire hanger may be bent out of shape, again requiring the user to reshape the hanger; the shoulder of a plastic hanger may break; the hook by which a wire hanger is hung on the rod may be bent out of shape; or the hook by which a plastic hanger is hung on the rod may be broken.

What is desired is an improved hanger that overcomes the disadvantages inherent in wire, wood or plastic hangers that have fixed, static shoulders (also referred to herein as "members"). The present invention has biased, collapsible members that advantageously allow the easy removal and placement of clothing thereon. With the present invention, a shirt with a button placket may be buttoned on a counter prior to placement on the hanger. The user may then hang the shirt on the hanger by collapsing the members of the hanger and inserting the collapsed hanger into the neck of the shirt from the top. This action is significantly easier than the action required to insert a fixed-member hanger through the bottom of the shirt and guide it through the neck from below. In addition, if the user so desires, the user may collapse the members of the hanger and remove the clothing item, thus permitting the user to leave the hanger on the rod permanently. The present invention can be tailored to several types and sizes of garment, primarily through creating multiple sizes of the hanger members.

According to one aspect of the present invention, the members of the hanger are adapted to pivot with respect to each other, so as to permit a first position in which the members are extended and adapted to hold the clothing item, and a second position in which the members are collapsed So as to permit the easy removal of the clothing item.

According to another aspect of the present invention, the pivot mechanism of the hanger has a variety of tension and spring mechanisms adapted to create potential energy therein when the members are moved to the second position, said potential energy then adapted to cause the members to return to the first position when released.

SUMMARY OF THE INVENTION

The present invention generally comprises a garment hanger that folds around a point or series of points near the hook of the hanger, and is adapted to automatically extend to its original unfolded position upon release. More specifically, the present invention is an improved hanger, also referred to as a suspension device, with a hook, and having a first member and a second member, with a pivot near the hook, adapted to allow movement of the first member and the second member between a first position and a second position. There is a bias device coupled with and adapted for biasing said first member and said second member toward said first position. The first position is an extended position for hanging a garment and the second position is an unextended position for enabling removal of said garment.

FIGURES OF THE INVENTION

For a better understanding of the present invention including its features, advantages and specific embodiments, reference is made to the following detailed description along with accompanying drawings in which.

DETAILED DESCRIPTION OF THE INVENTION

The present invention comprises an improved clothing hanger, or suspension device. As described more fully herein, with the present invention, the user can place a shirt on the counter and button a shirt with a button placket prior to placement of the shirt on the hanger. The user may then hang the shirt on the hanger by collapsing the hanger and inserting it into the neck of the shirt from the top. This action is significantly easier than the action required to insert the hanger through the bottom of the shirt and guide it through the neck from below.

The present invention can be fabricated to fit a variety of types and sizes of garments. This is accomplished by creating hangers with differently sized members that are adapted to be pivoted from the extended position to the collapsed position. For example, one hanger may have members that are each four inches in length, giving a total approximate length of eight inches across. A second hanger may have members that are each six inches in length, giving a total approximate length of twelve inches across.

Each embodiment of the present invention includes a mechanism, such as a spring-action or tension biased, hinge, located proximally to the hook component of the hanger. This hinge allows the hanger to fold, effectively reducing the width of the hanger. The hinge mechanism is adapted to keep sufficient tension on the members of the hanger to keep them expanded while the garment hangs on a clothing rod. In addition, the hinge mechanism has sufficient flexibility to allow the members of the hanger to fold together when the user intentionally folds the hanger to insert it into the neck of a garment or when the user pulls a garment off of the hanger from below.

Figure 1:
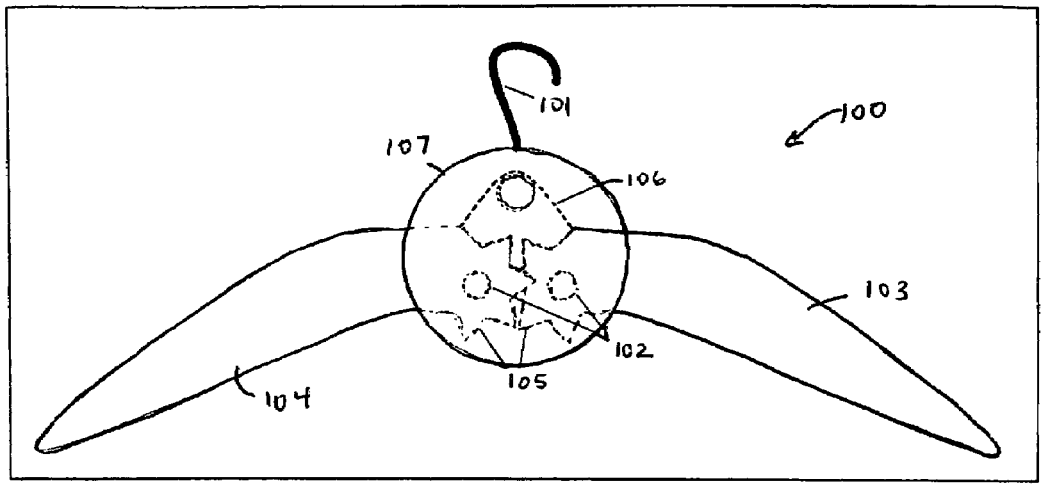
FIG. 1 depicts a front view of a first embodiment of the present invention.

FIG. 1 is a front view of a first embodiment of the present invention. As seen therein, hanger 100 has hook 101, a folding mechanism 107 in which each of the two members 103, 104 of hanger 100 rotate around fixed pins 102, a series of interlocking gear teeth 105 that ensure the symmetrical folding of hanger 100 and an elastic band 106 used as a tension mechanism to re-extend the members 103, 104 subsequent to being folded or collapsed.

Figure 2:
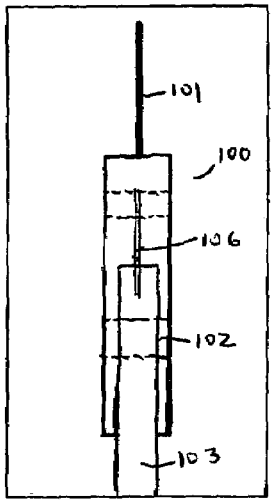
FIG. 2 depicts a side view of the first embodiment of the present invention.

FIG. 2 is a side view of hanger 100, including hook 101 and member 103 that rotates around fixed pin 102.

Figure 3:
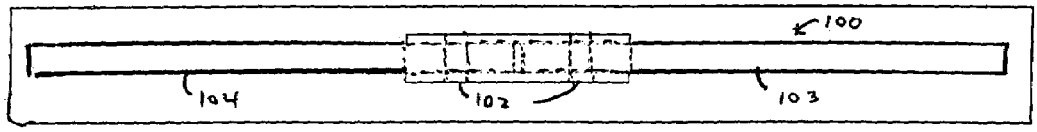
FIG. 3 depicts a top view of the first embodiment of the present invention.

FIG. 3 is a top view of hanger 100. Members 103 and 104 are shown in the extended position.

Figure 4:
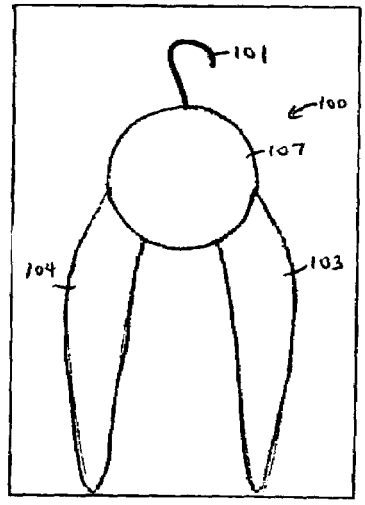
FIG. 4 depicts an exterior view of the first embodiment of the present invention in its folded position.

FIG. 4 is an exterior view of hanger 100, with members 103 and 104 in the folded or collapsed position.

Figure 5:
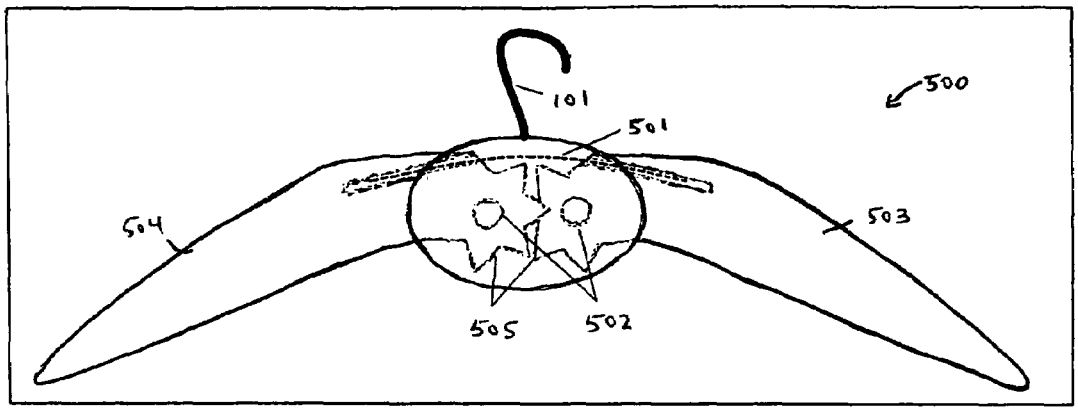
FIG. 5 depicts a front view of a second embodiment of the present invention.

FIG. 5 is a front view of a second embodiment of the present invention. In this embodiment, hanger 500 has hook 101, and a folding mechanism in which each of the two members 503, 504 rotate around a fixed pins 502. A series of interlocking gear teeth 505 allow the symmetrical folding of hanger 500. A semi-rigid insert 501 is used as a tension mechanism to re-extend the members 503, 504 after being folded or collapsed.

Figure 6:
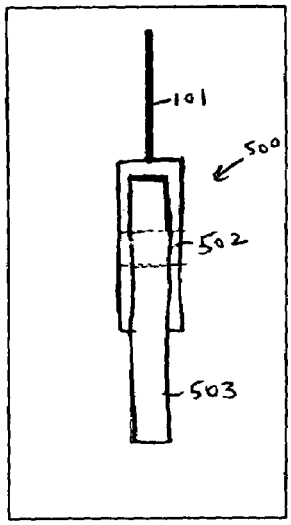
FIG. 6 depicts a side view of the second embodiment of the present invention.

FIG. 6 is a side view of hanger 500, including hook 101 and member 503 that rotates around fixed pin 502.

Figure 7:
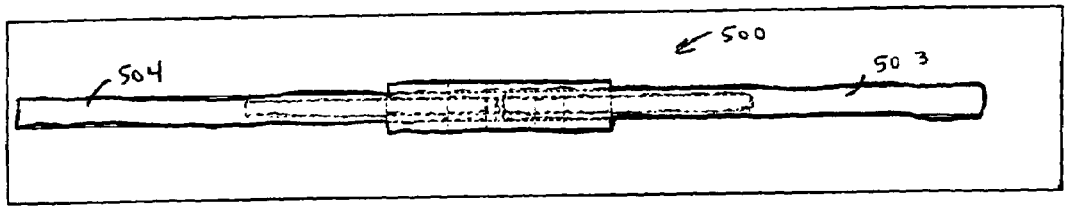
FIG. 7 depicts a top view of the second embodiment of the present invention with the hook removed.

FIG. 7 is a top view of hanger 500. Members 503 and 504 are shown in the extended position.

Figure 8:
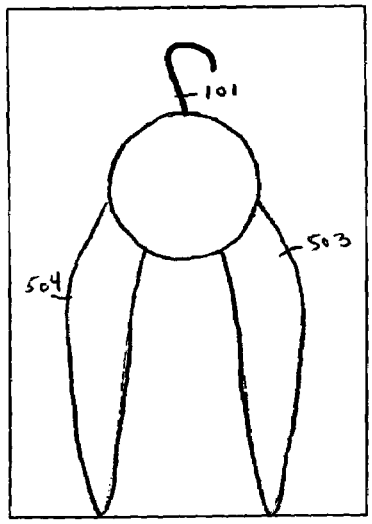
FIG. 8 depicts an exterior view of the second embodiment of the present invention in a folded position.

FIG. 8 is an exterior view of hanger 500, with members 503 and 504 in the folded or collapsed position.

Figure 9:
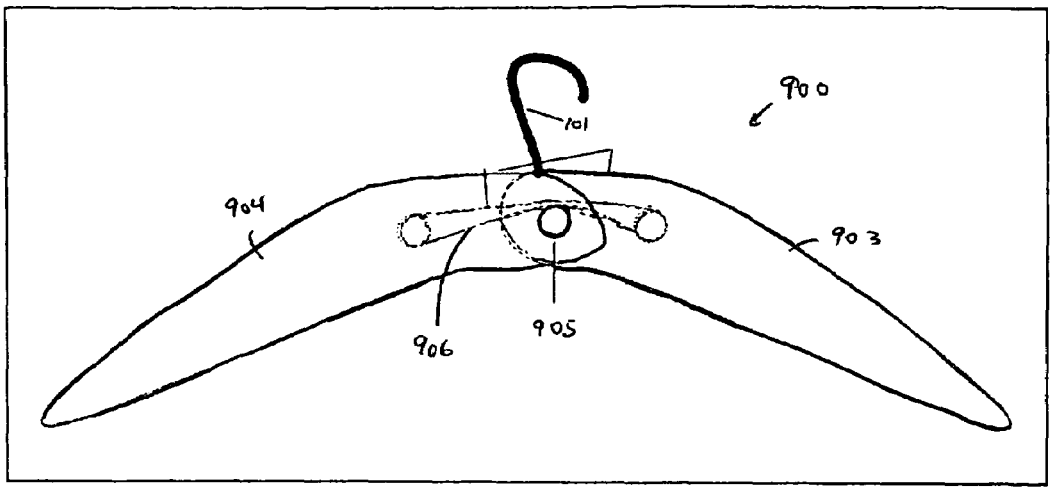
FIG. 9 depicts a front view of a third embodiment of the present invention.

FIG. 9 is a front view of a third embodiment of the present invention. In this embodiment, hanger 900 has hook 101, two interlocking members 903, 904, a folding mechanism in which one of the two members 903 or 904 rotate around a fixed point 905. The fixed point 905 can comprise a hollowed cylinder in the members 903, 904 with a dowel or similar plug being placed there through to pivotably hold the members in place. An elastic band 906 provides the tension necessary to re-position or re-extend the members 903, 904 after having been folded or collapsed.

Figure 10:
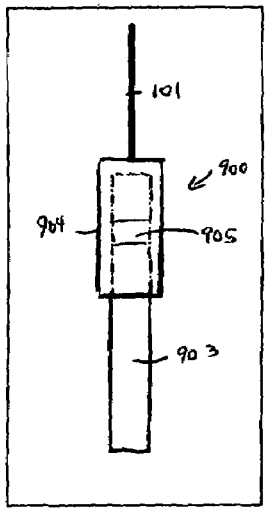
FIG. 10 depicts a side view of the third embodiment of the present invention.

FIG. 10 is a side view of hanger 900, including hook 101 and member 903 that rotates around fixed point 905. Member 904 contains a void into which the end of member 903 proximate the hook 101 is inserted and secured by a cylinder in a cylindrical shaft.

Figure 11:
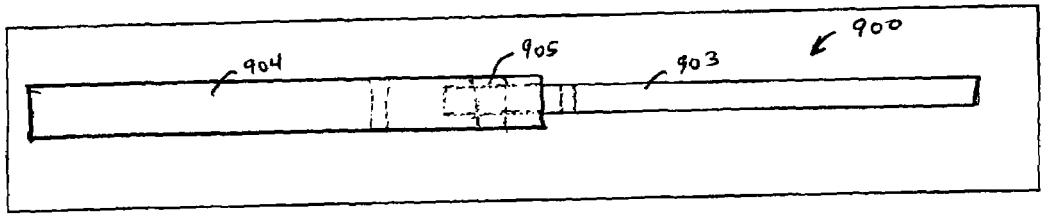
FIG. 11 depicts a top view of the third embodiment of the present invention with the hook removed.

FIG. 11 is a top view of hanger 900. Members 903 and 904 are shown in the extended position, held in place at pivot point 905.

Figure 12:
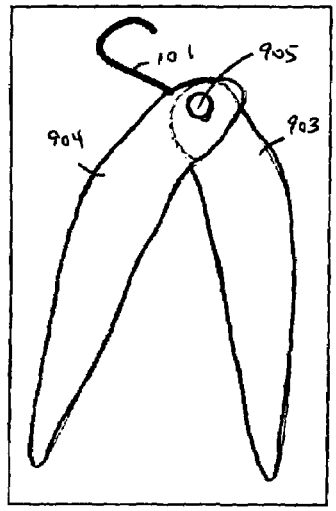
FIG. 12 depicts an exterior view of the third embodiment of the present invention in a folded position.

FIG. 12 is an exterior view of hanger 900, with members 903 and 904 held at pivot point 905 in the folded or collapsed position.

Figure 13:
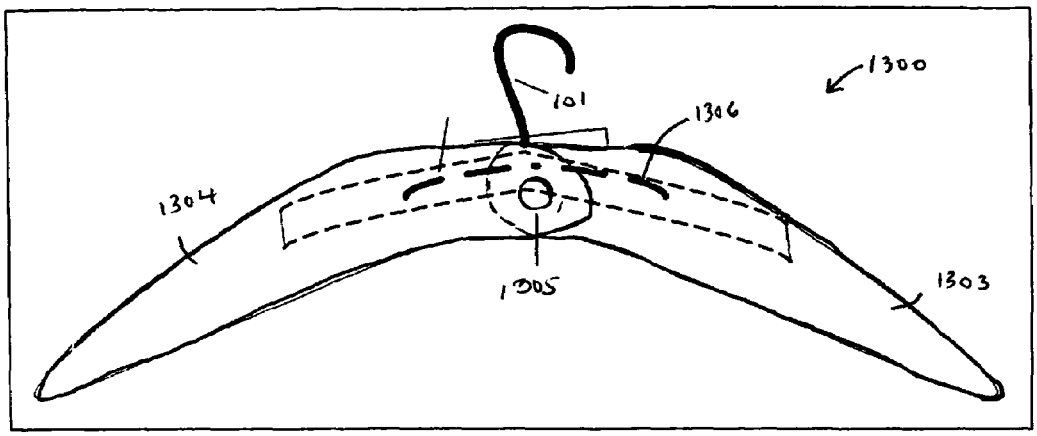
FIG. 13 depicts a front view of a fourth embodiment of the present invention.

FIG. 13 is a front view of a fourth embodiment of the present invention. As seen therein, hanger 1300 has hook 101, two interlocking members 1303, 1304 coupled at a folding mechanism in which one of the two members of the hanger 1300 rotates around a fixed point 1305 comprising a cylinder located snugly within a cylindrical shaft; and a semi-rigid insert 1306 used as a tension mechanism to re-position or re-extend the members 1303, 1304 after it has been folded or collapsed.

Figure 14:
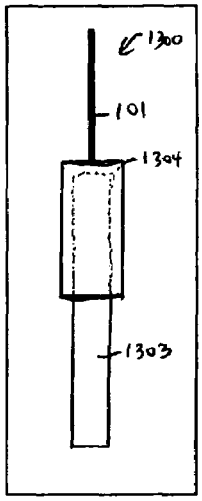
FIG. 14 depicts a side view of the fourth embodiment of the present invention.

FIG. 14 is a side view of the fourth embodiment of hanger 1300, including hook 101 and member 1303. Member 1304 contains avoid into which the end of member 1303 proximate the hook 101 is inserted and secured.

Figure 15:
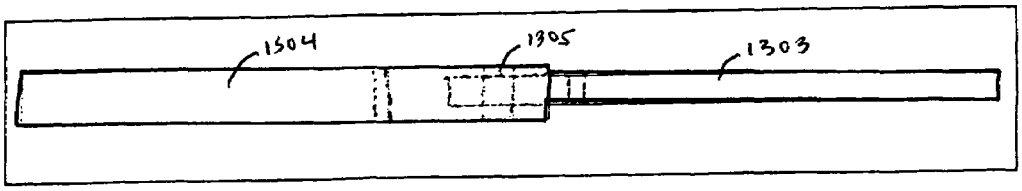
FIG. 15 depicts a top view the fourth embodiment of the present invention with the hook removed.

FIG. 15 is a top view of the fourth embodiment of hanger 1300. Members 1303 and 1304 are shown in the extended position, held in place at pivot point 1305.

Figure 16:
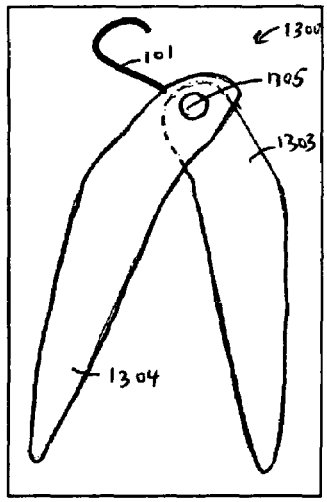
FIG. 16 depicts an exterior view of the fourth embodiment of the present invention in a folded position.

FIG. 16 is an exterior view of hanger 1300, with members 1303 and 1304 held at pivot point 1305 in the folded or collapsed position.

Figure 17:
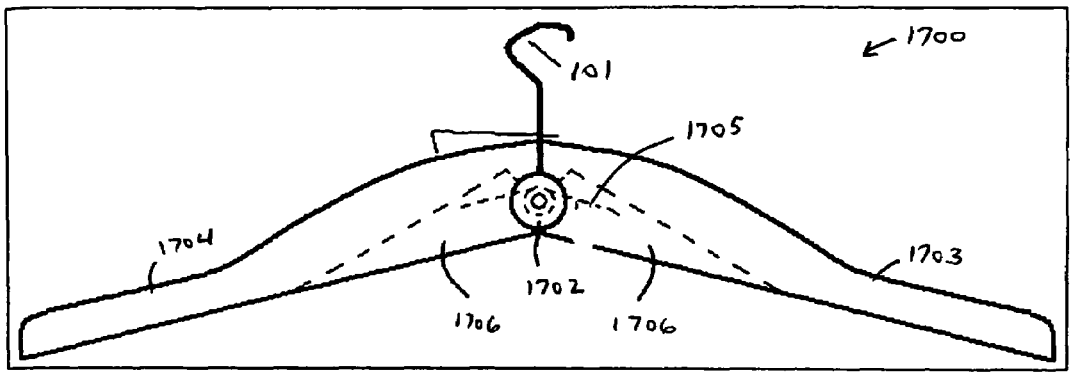
FIG. 17 depicts a front view of a fifth embodiment of the present invention.

FIG. 17 is a front view of a fifth embodiment of the present invention. As seen therein, hanger 1700 includes hook 101, a central disk 1702 around which the members 1703, 1704 of the hanger 1700 rotate, and to which hook 101 is attached. In addition, torsion spring 1705 is used as a tension mechanism to re-position or re-extend members 1703, 1704 after the members have been folded or collapsed. As seen therein, members 1703, 1704 are shaped so as to incorporate recessed areas 1706 adapted to permit members 1703, 1704 to nestle partially within each other when hanger 1700 is in the folded or collapsed position.

Figure 18:
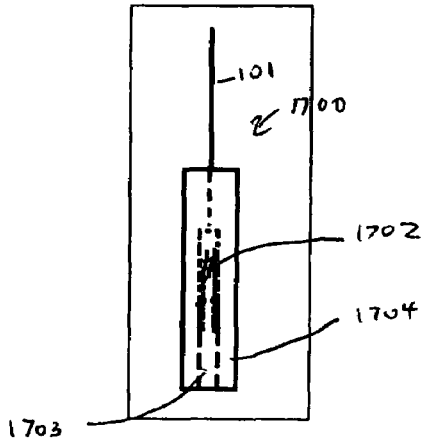
FIG. 18 depicts a side view of the fifth embodiment of the present invention.

FIG. 18 is a side view of hanger 1700, including hook 101 and member 1703 that rotates around fixed point 1705. Member 1704 contains a recessed area 1706 into which the end of member 1703 proximate the hook 101 is secured at a pivot point 1702.

Figure 19:
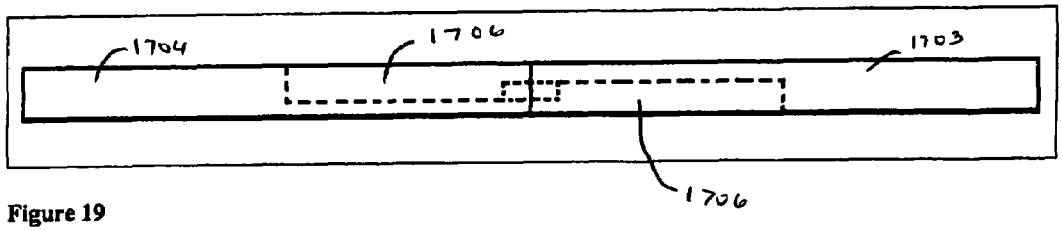
FIG. 19 depicts a top view of the fifth embodiment of the present invention with the hook removed.

FIG. 19 is a top view of hanger 1700. Members 1703 and 1704 are shown in the extended position, held in place at pivot point 1705.

Figure 20:
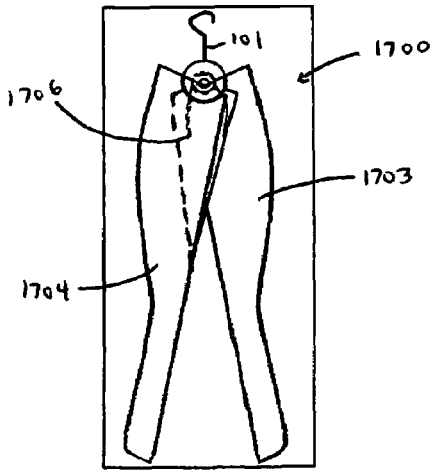
FIG. 20 depicts an exterior view of the fifth embodiment of the present invention in a folded position.

FIG. 20 is an exterior view of hanger 1700, with members 1703 and 1704 held at pivot point 1705 in the folded or collapsed position.

Figure 21:
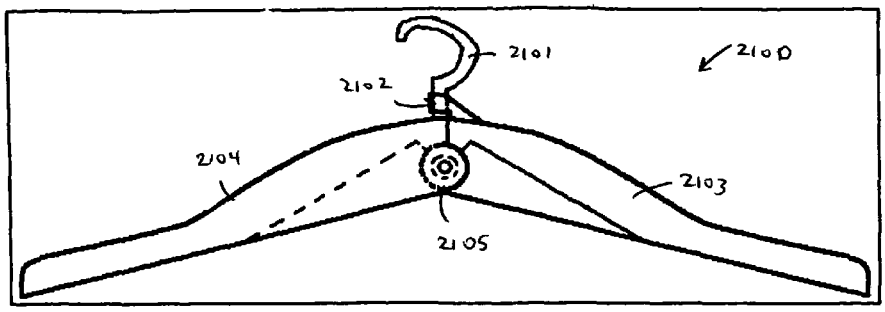
FIG. 21 depicts a side view of the complete assembly of a sixth embodiment of the present invention.

FIG. 21 is a side view of the complete assembly of the sixth embodiment of the present invention. As seen therein, hook 2101 of hanger 2100 is molded of a plastic material. Plastic spring clip 2102 holds the hanger closed and releases under tension. Member 2104 has the hook 2104 molded integral therewith. Member 2103 has clip 2102 molded integrally therein. Hanger 2100 pivots at point 2105, allowing members 2103 and 2104 to be collapsed or folded together.

Figure 22:
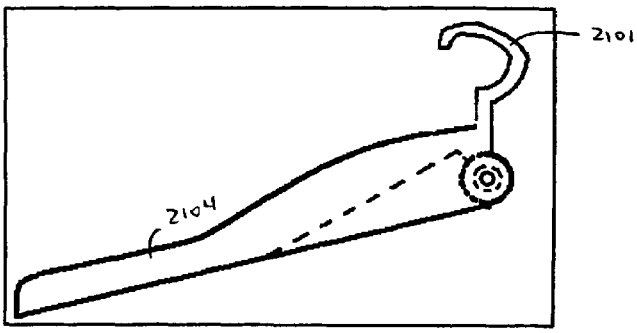
FIG. 22 depicts a side view of the hook-bearing half of the sixth embodiment of the present invention.

FIG. 22 is a side view of member 2104 of hanger 2100. As seen therein, member 2104 is the hook 2101 bearing half of hanger 2100.

Figure 23:
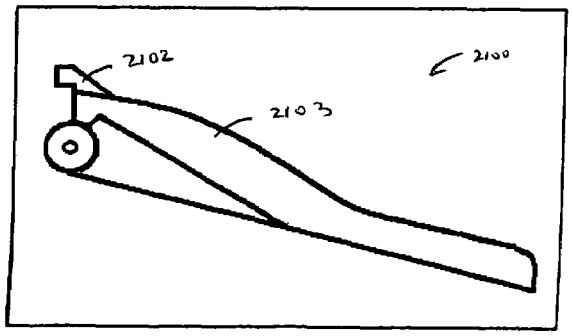
FIG. 23 depicts a side view of the clip-bearing half of the sixth embodiment of the present invention.

FIG. 23 is a side view of member 2103 of hanger 2100. As seen therein, member 2103 is the clip 2102 bearing half of hanger 2100.

Figure 24:
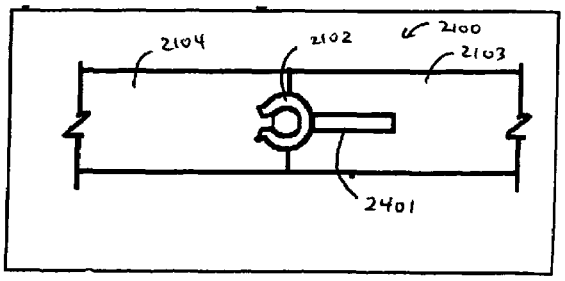
FIG. 24 depicts a top view of the clip mechanism of the sixth embodiment of the present invention with the curved portion of the hook removed.

FIG. 24 is a top, partial view of hanger 2100 with the curved portion of the hook removed. As seen therein, the clip mechanism 2102 is molded into member 2103 and includes flange 2401 molded into and orthogonal to the member and the clip, so as to provide support for the partial, cylindrical clip 2102.

Figure 25:
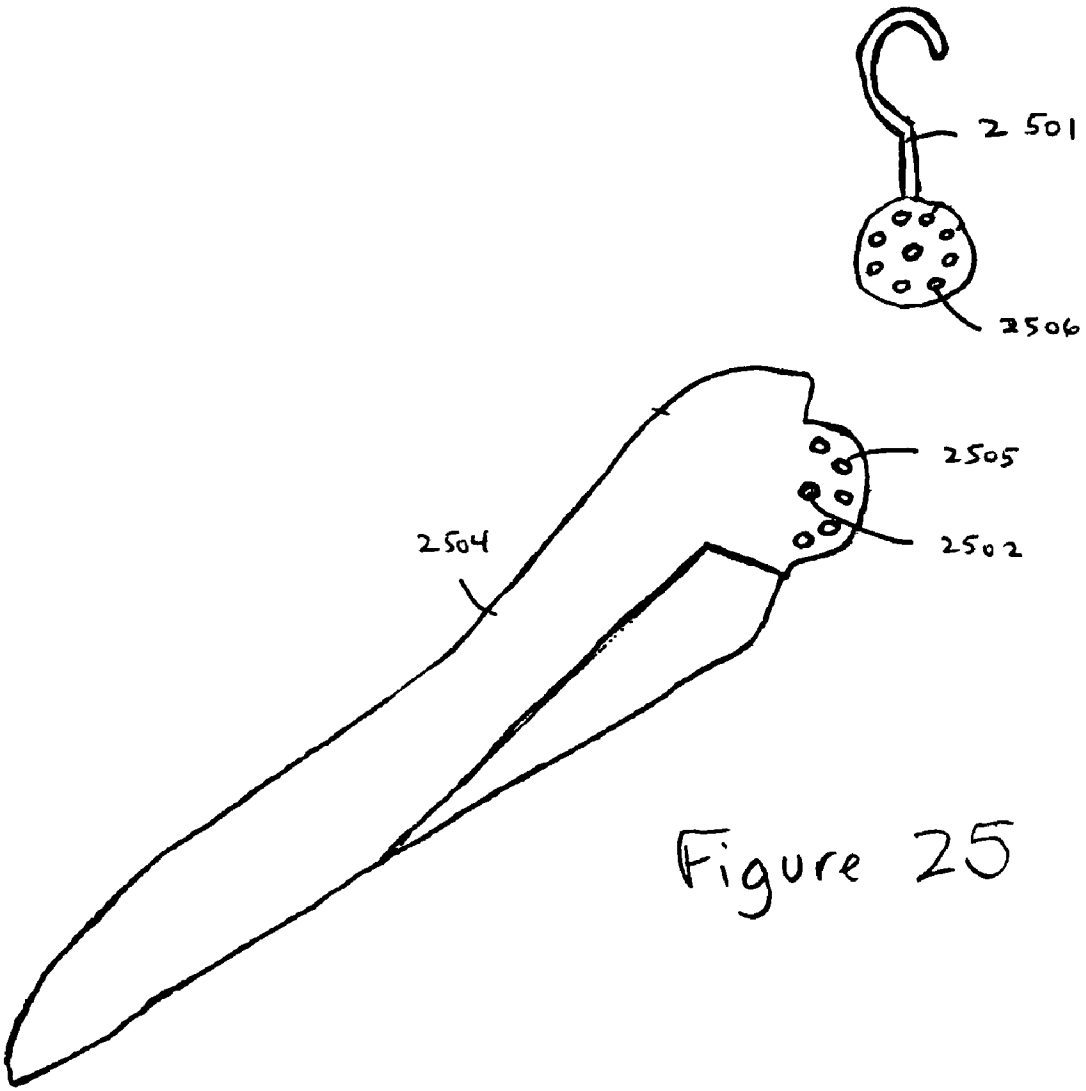
FIG. 25 depicts a seventh embodiment of the present invention.

FIG. 25 depicts part of a seventh embodiment of the present invention. As seen therein, the members of hanger 2500 can be coupled with an integral hook/pivot mechanism 2501. Member 2504 has a hole 2502 through which a fastener can be threaded to hold the parts of member 2504 to the other member (not shown). Member 2504 and the other member not shown would have molded integral therewith bumps 2505, having a corresponding depressions 2506 in the integral hook/pivot mechanism 2501. When mated, the depressions and bumps would align, thus holding the members into a semi-locked position, either extended or collapsed. As in the other embodiments of the present invention, a tension mechanism can be included to cause the collapsed hanger 2500 to extend when pressure holding hanger 2500 in the collapsed position is released.

Figure 26:
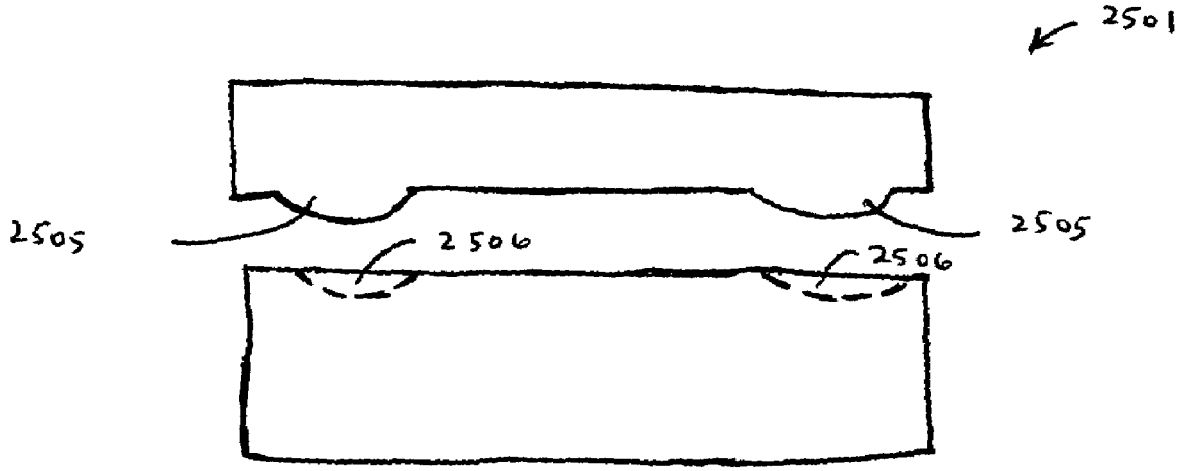
FIG. 26 depicts a side view of the rotating mechanism of the seventh embodiment of the present invention.

FIG. 26 depicts a side view of the rotating mechanism of the integral hook/pivot mechanism 2501 of hanger 2500, with bumps 2505 and depressions 2506.

Figure 27:
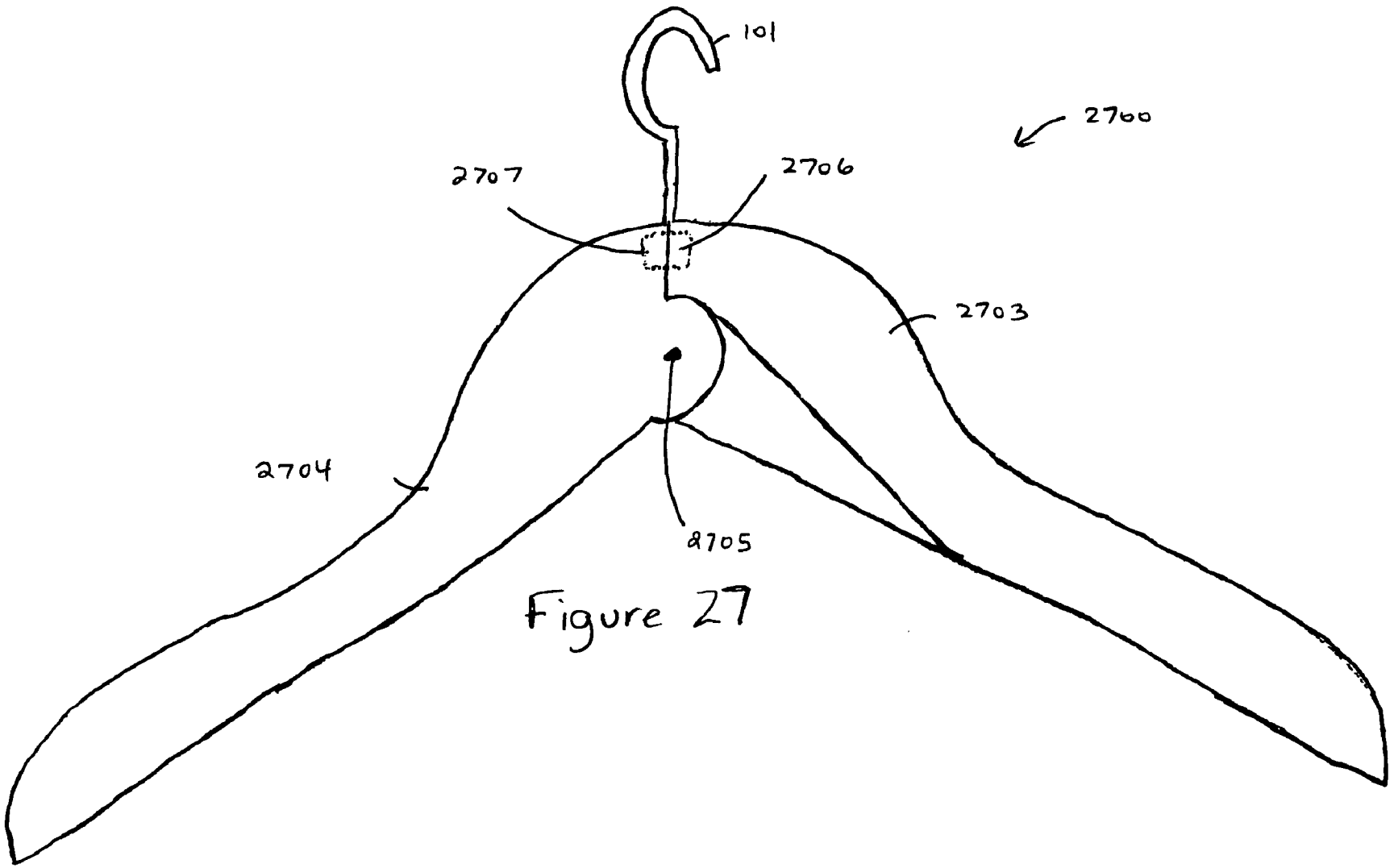
FIG. 27 depicts a view of an eighth embodiment of the present invention with internal magnets embedded in the members.

FIG. 27 depicts a view of a eighth embodiment of the present invention. As seen therein, hanger 2700 has hook 101, members 2703 and 2704, pivot point 2705 and internal magnets 2706, 2702 embedded in the members 2703, 2704, operable to assist the tension mechanism therein (not shown) in keeping hanger 2700 in the extended position.

Figure 28:
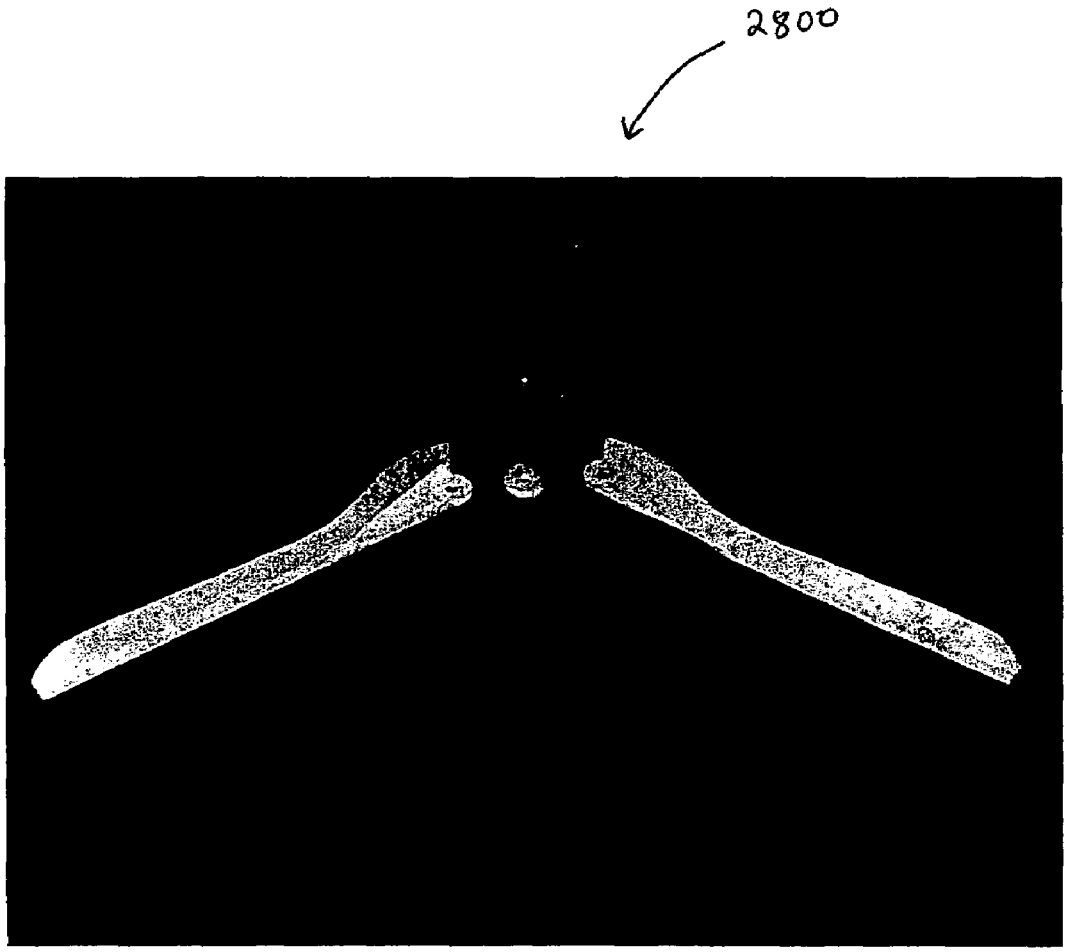
FIG. 28 depicts a disassembled hanger of the present invention.

FIG. 28 depicts the disassembled hanger 2800 of the present invention.

As seen in the several embodiments of the present invention, the hanger has at least two components, the right and left member, which are pivotably coupled. Further, a tension mechanism can be employed to permit the two members to collapse or fold, when sufficient torque is applied to members, but then return to their original extended position when the torque pressure is released. In each of these embodiments, the pivot point is proximal to the hook. The members can be fabricated from wood, plastic or other suitable, resilient, yet flexible material. The hooks can be fabricated from a variety of materials, such as metal or can be integrally molded into the halves of the hanger assembly. In the plastic embodiment of the present invention, a spring clip mechanism can molded into one half of the hanger, operable to hold the hanger in the open position for hanging.

As seen in the Figures, the shape of the members can be fabricated to allow these hanger halves to be nestled together using the cut-outs in each half. This embodiment allows for the low-cost molding of each half from a solid piece of plastic and results in a more aesthetically pleasing shape to the hanger. Alternatively, the members can be pivotably coupled without a tension mechanism such that the members, once uncoupled, so not automatically return to the original, unfolded state. This embodiment obtains the advantages of the present invention while reducing the additional cost and complexity of manufacturing the hanger with a spring or tension mechanism.

In those embodiments that include the spring or tension mechanism, the hanger can be designed to have an inherent amount of force that holds the members in the extended positions. Each tension requires a specific amount of torque to force the members into the collapsed position. Three mechanisms in particular can be used to establish this tension. These include a pair of magnets embedded into each side of the hanger with their north and south poles facing each other when the hanger is in the extended position; a spring clip molded into the hanger that holds onto the hook; and a series of bumps and depressions on the mated surfaces of a central pivoting disk. In addition to the embodiments illustrated, a three-piece design is also possible, which is adapted to allow the hanger to fold symmetrically about the central point.

The innovative teachings of the present invention are described with particular reference to its use in clothing hangers. It should be understood and appreciated by those skilled in the art that the uses, and embodiment described herein provide only a few examples of the many advantageous uses and innovative teachings herein. For example, the present invention can be tailored to several types and sizes of garment, primarily through creating multiple sizes of the hanger, each with a different length for the members. In addition, the members of the present invention may be fabricated from any number of material compositions, such as wood, plastic, hardened rubber or other similar material. Further, different tension mechanisms can be used to cause the members to automatically return to their extended positions. Various alterations, modifications and substitutions can be made to the disclosed invention without departing in any way from the spirit and scope of the invention.

What is claimed is:

1. A suspension device comprising:

a first arm member and a second arm member having a pivot adapted to allow movement of the first member and the second member between a first position and a second position, one of the first member or the second member having a hook;

wherein the first member has a securing mechanism configured to selectively couple to the second member in the first position, and further configured to selectively release from the second member in the second position; and wherein the securing mechanism comprises the first member having a protrusion extending from a first surface, and the second member having a receptacle in a second surface opposing the first surface and configured to selectively engage the protrusion in a friction fit arrangement wherein the receptacle overlaps the protrusion to secure the device in the first position.

2. The device of claim 1 further including a bias device coupled with and adapted for biasing said first member and said second member toward said first position.

3. The device of claim 2, wherein said first position is an extended position for hanging a garment and said second position is an un-extended position for enabling removal of said garment.

4. The device of claim 3, wherein the bias device comprises a tension mechanism coupled between the first member and the second member;

the tension mechanism being configured with a predetermined tension force operable to develop potential energy therein when the members are moved to the second, un-extended position, said potential energy operable to create an upwardly directed torque force; and said upwardly directed torque force predisposing the members to revert to their first, extended position when the force holding the members in the second, un-extended position is less than the upwardly directed torque force.

5. The device of claim 4, wherein the tension mechanism comprises at least one resilient wire.

6. The device of claim 4, wherein the tension mechanism comprises at least one elastic band.

7. The device of claim 4, wherein the tension mechanism comprises at least one spring.

8. The device of claim 3, wherein the bias device comprises a tension mechanism with an adjustable tension force configured to develop a user-defined potential energy therein when the members are moved to the second, un-extended, position, said potential energy operable to create an upwardly directed torque force; and said upwardly directed torque force predisposing the members to revert to their first, extended position when the force holding the members in the second, un-extended, position is less than the user-selected upwardly directed torque force.

9. The device of claim 1, further comprising a first magnet being embedded in an end of the first member proximal the pivot and having a north pole facing outward from the end of the first member;

a second magnet being embedded in an end of the second member proximal the pivot and having a south pole facing outward from the end of the second member; and the opposing polarities of the magnets coming into proximal contact when the first member and second member are in the first position.

10. The device of claim 1, wherein the securing mechanism further comprises a disk;

the disk being disposed between the first surface of the first member and the second surface of the second member proximal to the pivot; and the disk having a co-efficient of friction relative to the face of the first member and the face of the second member.

11. The device of claim 1, further comprising;

a gearing mechanism coupling the first member and the second member;

said gearing mechanism comprising a semi-circular set of gear teeth integral to the end of the first member proximal the pivot;

a semi-circular set of gear teeth integral to the end of the second member proximal the pivot;

the gear teeth integral to the first member being mated to the gear teeth of the second member;

the gearing mechanism operable to cause the second member to rotate toward the first member when a torque is applied to the first member; and a tension mechanism operable to re-extend the first member and second member after being folded or collapsed.

12. The device of claim 1, wherein the securing mechanism is positioned proximate the pivot.

13. The device of claim 1, wherein the first member and the second member are fabricated from plastic.

14. The device of claim 13, further comprising a retaining clip being integrally molded into the first member proximal the pivot;

a hook having a hook neck and curved portion are molded integral to the second member proximal the pivot;

the retaining clip is dimensioned to accept and securely hold the hook neck; and the hook neck is operable to snap into the retaining clip so as to hold the device in the extended position.

* * * * *